United States Patent [19]

Gall

[11] Patent Number: 4,563,000

[45] Date of Patent: Jan. 7, 1986

[54] ROWING APPARATUS

[75] Inventor: John C. Gall, Chicago, Ill.

[73] Assignee: Sears, Roebuck and Co., Chicago, Ill.

[21] Appl. No.: 665,050

[22] Filed: Oct. 26, 1984

[51] Int. Cl.[4] ..... A63B 69/06

[52] U.S. Cl. ..... 272/72

[58] Field of Search ..... 272/72, 134, 137, 138, 272/139, 142, 93; 128/25 R; 280/223, 224, 225

[56] References Cited

U.S. PATENT DOCUMENTS

| | | | |
|---|---|---|---|
| D. 268,278 | 3/1983 | Smith . | |
| 381,187 | 4/1888 | Tracy et al. | 272/72 |
| 631,531 | 8/1899 | Sargent | 280/224 |
| 641,596 | 1/1900 | Kerns | 272/72 |
| 3,473,843 | 10/1969 | Hart . | |
| 3,545,748 | 12/1970 | Delinger . | |
| 3,614,097 | 10/1971 | Blickman . | |
| 3,658,327 | 4/1972 | Thiede . | |
| 3,659,844 | 5/1972 | Cummins . | |
| 3,709,487 | 1/1973 | Walker . | |
| 3,741,538 | 6/1973 | Lewis et al. . | |
| 3,770,267 | 11/1973 | McCarthy . | |
| 3,819,176 | 6/1974 | Cummins . | |
| 3,851,916 | 12/1974 | Quartullo | 272/72 X |
| 3,904,196 | 9/1975 | Berlin | 272/72 |
| 3,912,264 | 10/1975 | Busse et al. . | |
| 4,284,272 | 8/1981 | Evans et al. . | |
| 4,286,782 | 9/1981 | Fuhrop . | |
| 4,403,773 | 9/1983 | Swann . | |

FOREIGN PATENT DOCUMENTS

| | | | |
|---|---|---|---|
| 190855 | 10/1907 | Fed. Rep. of Germany | 272/72 |
| 4259 | of 1908 | United Kingdom | 272/72 |

*Primary Examiner*—Robert A. Hafer
*Assistant Examiner*—Arnold W. Kramer
*Attorney, Agent, or Firm*—John T. Winburn

[57] ABSTRACT

An improved rowing apparatus has a back bearing surface coupled to the oar arms of the apparatus to maximize the rowing exercise. The bearing surface can be fixed to a seat back of a seat movably mounted on the frame of the apparatus. The seat back can be pivotably mounted to the seat to maximize the forces of the leg, back and arm muscles in the rowing exercise.

22 Claims, 4 Drawing Figures

ROWING APPARATUS

BACKGROUND OF THE INVENTION

The invention relates generally to exercise machines and more particularly to an improved type of rowing apparatus. The rowing apparatus is designed to improve the maximization of the muscle groups being exercised to obtain the most benefit from the rowing type exercises.

In the exercise equipment field, numerous types of rowing exercise machines have been developed which provide a basic rowing exercise position. Generally, these machines provide an elongate frame with a seat slidably engaged on the frame, foot rests at one end of the frame and a lever arm or pair of arms biased to provide resistance to the conventional rowing action.

A particular type of rowing exercise machine provides a pair of inward oar arms pivotable mounted on support arms mounted outwardly on opposite sides of the frame. This oar type of rowing machine provides a basic well known rowing exercise position substantially equivalent to rowing a boat with the force applied to the inboard end of an oar pivotably mounted on the boat which force is resisted by the outboard end of the oar in the water. In the rowing machine, the inboard oar section is directly coupled to resistive means to counteract and absorb the energy input.

Generally, in a conventional boat the seat is stationary and the resistance between the seat and the operator's feet braced against the boat provide the horizontal reaction to the forces applied to the inboard oars. These forces are generated by the back and arm muscles of the operator in series. Generally, the back muscles are the maximizing limit, because their strength exceeds the bending strength of the arms which straighten out to transmit the higher back force. Conversely, if the bending strength of the arms exceeds that of the back muscles, then the back would yield.

In a racing shell and in the above mentioned conventional rowing apparatus, a low friction movable seat is provided and stationary foot rests provide the reaction element. Although the movable seat provides additional travel for the oars, the bending of the legs is now placed in series with that of the back and arms. The maximizing force generally remains the back muscles, although the leg muscles do have a somewhat higher exercise potential. Again, if the leg strength exceeds that of the back muscles, then the back would again yield.

Therefore, there is a need for an improved rowing apparatus which provides for an improved maximization of the muscle groups utilized in the rowing exercise.

SUMMARY OF THE INVENTION

The above and other disadvantages of the prior art exercise apparatus and techniques are overcome in accordance with the present invention by providing an improved rowing apparatus which increases the amount of potential muscle energy which can be applied to the oars in the apparatus. The improved rowing apparatus has a frame, a movable seat mounted on the frame, a pair of inward pivotably mounted oar arms which include flexible tensioning means coupled between the oar arms and a back bearing surface.

The back bearing surface can be fixed to the seat. The flexible tensioning means can be adjustable along the length of the oar arms to adjust the relative travel of the legs and upper torso of the operator to synchronize the rowing motions. The back bearing surface can be pivotably mounted to the seat to maximize the individual efforts of all three muscle groups in the rowing exercise.

DESCRIPTION OF THE PREFERRED EMBODIMENTS

Figure 1:
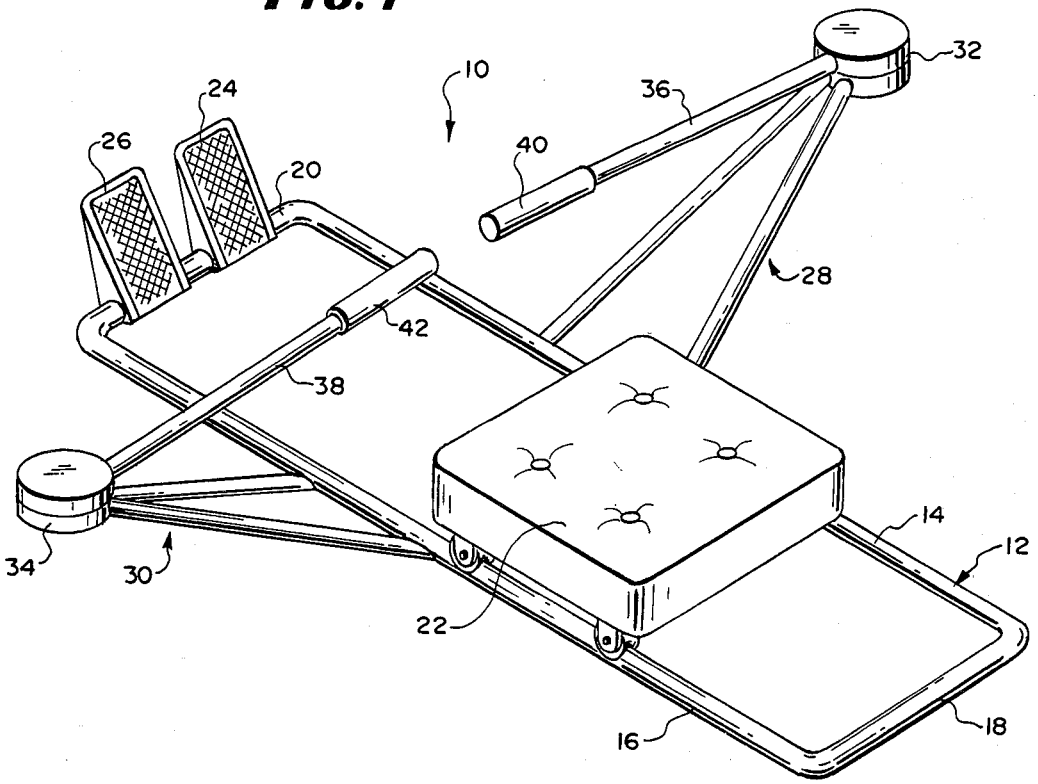
FIG. 1 is a perspective view of a prior art type of rowing exercise machine.

Referring to FIG. 1, a prior art type of exercise rowing machine 10 is illustrated. The machine 10 includes a frame 12 which is formed by a pair of bars or guide rails 14 and 16 secured or joined by a pair of end crosspieces 18 and 20. The frame 12 includes a seat 22 reciprocally mounted on the rails 14 and 16. The end crosspiece 20 includes a pair of foot rests 24 and 26.

A pair of support arm assemblies 28 and 30 are mounted outward from the frame 12. The assemblies 28 and 30 each have a respective resistive element 32 and 34 mounted thereon, which provide the energy absorption and dissipation means for respective oar arms 36 and 38. The oar arms 36 and 38 include respective hand grips 40 and 42 and are pivotably mounted with the resistive elements 32 and 34 to provide a substantially horizontal accurate rowing movement. The resistive elements 32 and 34 generally provide an adjustable resistance to a rearward or pulling motion and little or no resistance in the return motion provided by bending the knees upwardly. As stated above, this type of rower places the legs in series with the back and arms. Although some exercise potential is provided for the legs, the back muscles generally remain the limiting factor.

Figure 2:
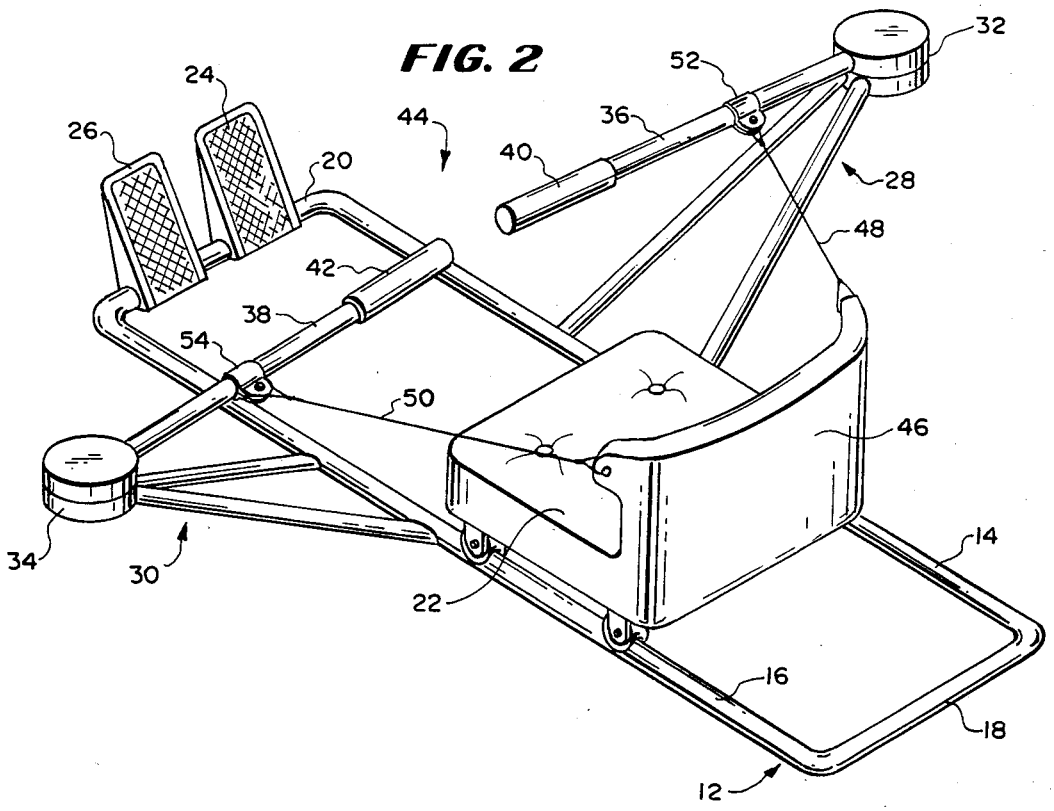
FIG. 2 is a perspective view of a first embodiment of an improved rowing exercise apparatus employing the present invention.

Referring now to FIG. 2, a first rowing apparatus embodiment 44 of the invention is illustrated. The same numerals have been utilized for elements which are the same or equivalent to those described in FIG. 1. The apparatus or rower 44 provides a bearing surface for the lower back of the operator. In this embodiment, the bearing surface is provided by a seat back 46 on the seat 22. The bearing surface or seat back is preferably part of or affixed to the seat 22; however, the bearing surface can be separate from and entirely unconnected to the seat 22.

A pair of cables or other, preferably flexible tensioning means 48 and 50 are coupled between the seat bearing surface or seat back 46 and respective oar arms 36 and 38. The flexible tensioning means 48 and 50 preferably are attached to the oar arms 36 and 38 by respective brackets 52 and 54, which preferably are movably mounted along the length of the oar arms 36 and 38.

In this embodiment, the back and leg muscles can be selectively applied since they are no longer in series, but are applied as parallel forces and hence can increase the energy dissipated in the rowing exercise. With the seat 22 and the oar arms 36 and 38 in the forward position, the operator's knees are bent upwardly with the feet bearing against the foot rests 24 and 26. When the legs are straightened there are forces exerted against the foot rests 24 and 26 and against the back bearing surface 46.

Since the seat 22 is movably mounted, the force on the seat back 46 translates directly to tension in the cables 48 and 50 which provide a rearward force on the oar arms 36 and 38. This rearward force is independent and in parallel with the action of the upper torso of the operator. The back and arm muscles can apply additional force to the oar arms 36 and 38 in the conventional manner with the hand grips 40 and 42.

The adjustable brackets 52 and 54 are utilized to synchronize the motion of the legs and the upprer torso, which vary due to the different relative horizontal travel of the legs and upper torso which vary with the physique of different operators. The legs and back now operate independently; however, the arms remain in series with the back.

Figure 3:
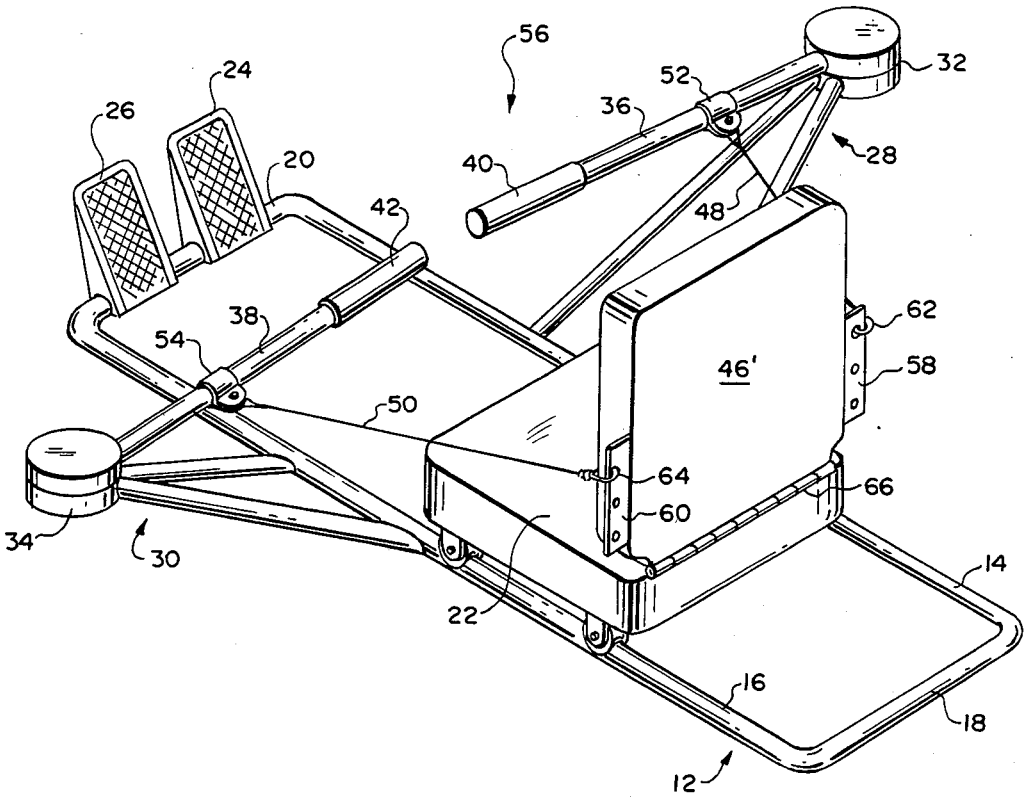
FIG. 3 is a perspective view of a second embodiment of the improved rowing exercise apparatus employing the present invention.

Referring now to FIG. 3, a second rowing apparatus embodiment 56 of the invention is illustrated. The same numerals have again been utilized for elements which are the same or equivalent to those described in FIGS. 1 and 2. The apparatus or rower 56 includes a back bearing surface 46' which is a high seat back. The seat back 46' includes a pair of brackets 58 and 60 mounted along opposite sides of the seat back 46'. The cables 48 and 50 are adjustably mounted to the brackets 58 and 60 by respective attaching means 62 and 64, such as a clip or hook and eye type configuration. The seat back 46' is pivotably mounted to the seat 22 by pivotal means 66, such as a hinge.

In this embodiment, the back and leg muscles again can be selectively applied and in addition, the arm muscles can also be selectively applied since all three muscle groups are applied as parallel forces. This further increases the energy which can be dissipated in the rowing exercise and maximize the forces which can be applied by all three muscle groups. With the seat 22 and the oar arms 36 and 38 in the forward position, the operator's knees are again bent upwardly with the feet bearing against the foot rests 24 and 26. When the legs are straightened there again are forces exerted against the foot rests 24 and 26 and rearward against the lower back bearing surface 46' as shown by arrow 69 (FIG. 4).

Figure 4:
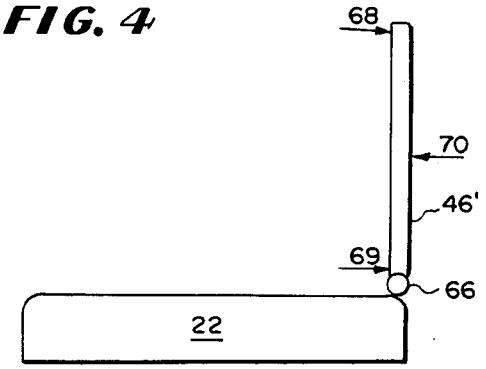
FIG. 4 is a side elevational view illustrating the force exerted on the embodiment of FIG. 3.

In addition, the operator now can push rearwardly with the back muscles pivoting the seat back 46' as illustrated by the arrow 68 in FIG. 4, this force generally being applied on the upper portion of the seat back 46', applying an additional rearward force. Since the seat back 46' is pivotably mounted and the forces 68 and 69 are rearwardly directed, a reactive force 70 is required for equilibrium. This force 70 is a summation of forces 68 and 69 and is transmitted to the oar arms 36 and 38 by the cables 48 and 50. By adjusting the vertical location of the attaching means 62 and 64, the back and leg forces then can be balanced which permits the arm forces to be applied independently. This prevents the back muscles from exceeding the arm muscles and hence maximizes the potential in the rowing exercise.

Modification and variations of the present invention are possible in light of the above teachings. The frame 12 can be of any number of configurations and can be of an adjustable length as desired. The foot rests 24 and 26 also can be adjustably mounted on the frame 12. It is therefore to be understood that within the scope of the appended claims, the invention may be practiced otherwise than as specifically described.

What is claimed and desired to be secured by Letters Patent of the United States is:

1. An improved rowing apparatus, comprising:
an elongate support frame;
a seat movably engaged on said frame;
a pair of oar arms pivotably mounted on said frame for resistive motion in at least one direction; and
means for selectively applying the muscle forces of an operator to said seat and oar arms, said means including tension means coupled between said oar arms and an operator back bearing surface, said surface bearing against the back of the operator to increase the energy which can be dissipated in the rowing exercise to substantially maximize the forces which can be applied by the leg, arm and back muscles.

2. The apparatus as defined in claim 1 wherein said back bearing surface is mounted to said seat.

3. The apparatus as defined in claim 2 wherein said back bearing surface is a seat back fixedly mounted to said seat.

4. The apparatus as defined in claim 3 wherein said tension means are cables, one coupled from each oar arm to opposite sides of said seat back.

5. The apparatus as defined in claim 4 wherein said cables include means for adjusting the relative movement of said seat and said oar arms.

6. The apparatus as defined in claim 5 wherein said adjusting means include cable mounting brackets which are adjustable along the length of said oar arms.

7. The apparatus as defined in claim 2 wherein said back bearing surface is a seat back pivotably mounted to said seat.

8. The apparatus as defined in claim 7 wherein said tension means are cables, one coupled from each oar arm to opposite sides of said seat back.

9. The apparatus as defined in claim 8 wherein said cables include means for adjusting the relative movement of said seat, said seat back and said oar arms.

10. The apparatus as defined in claim 9 wherein said adjusting means include cable mounting brackets which are adjustable along the length of said oar arms.

11. The apparatus as defined in claim 9 wherein said adjusting means include cable mounting brackets which are adjustable along said sides of said seat back.

12. In a rowing exercise machine including a frame, a seat movably engaged on said frame, a foot rest at one end of said frame, a pair of oar arms pivotably mounted on said frame and means for providing resistance to movement of said oar arms in at least one pivot direction, the improvement comprising:
means for selectively applying the muscle forces of an operator to said seat and oar arms, said means including tension means coupled between said oar arms and an operator back bearing surface said surface bearing against the back of the operator to increase the energy which can be dissipated in the rowing exercise to substantially maximize the forces which can be applied by the leg, arm and back muscles.

13. The improvement as defined in claim 12 wherein said back bearing surface is mounted to said seat.

14. The improvement as defined in claim 13 wherein said back bearing surface is a seat back fixedly mounted to said seat.

15. The improvement as defined in claim 14 wherein said tension means are cables, one coupled from each oar arm to opposite sides of said seat back.

16. The improvement as defined in claim 15 wherein said cables include means for adjusting the relative movement of said seat and said oar arms.

17. The improvement as defined in claim 16 wherein said adjusting means include cable mounting brackets which are adjustable along the length of said oar arms.

18. The improvement as defined in claim 13 wherein said back bearing surface is a seat back pivotably mounted to said seat.

19. The improvement as defined in claim 18 wherein said tension means are cables, one coupled from each oar arm to opposite sides of said seat back.

20. The improvement as defined in claim 19 wherein said cables include means for adjusting the relative movement of said seat, said seat back and said oar arms.

21. The improvement as defined in claim 20 wherein said adjusting means include cable mounting brackets which are adjustable along the length of said oar arms.

22. The apparatus as defined in claim 21 wherein said adjusting means include cable mounting brackets which are adjustable along said sides of said seat back.

* * * * *